US011541517B2

(12) United States Patent
Hsieh

(10) Patent No.: US 11,541,517 B2
(45) Date of Patent: Jan. 3, 2023

(54) THREE-PIECE WRENCH

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 349 days.

(21) Appl. No.: 16/868,305

(22) Filed: May 6, 2020

(65) Prior Publication Data

US 2020/0398408 A1 Dec. 24, 2020

(30) Foreign Application Priority Data

Jun. 19, 2019 (TW) ..... 108121365

(51) Int. Cl.

| | |
|---|---|
| ***B25B 23/00*** | (2006.01) |
| ***B25B 13/10*** | (2006.01) |
| ***B25B 13/46*** | (2006.01) |
| ***B25B 23/16*** | (2006.01) |
| ***B25G 1/04*** | (2006.01) |
| ***B25G 3/10*** | (2006.01) |

(52) U.S. Cl.

CPC ..... *B25B 23/0021* (2013.01); *B25B 13/107* (2013.01); *B25B 13/46* (2013.01); *B25B 23/16* (2013.01); *B25G 1/043* (2013.01); *B25G 3/10* (2013.01)

(58) Field of Classification Search

CPC . B25G 1/043; B25G 1/04; B25G 4/10; B25G 3/10; B25B 23/0021; B25B 23/16; B25B 13/107; B25B 13/46

See application file for complete search history.

(56) References Cited

U.S. PATENT DOCUMENTS

| | | | | |
|---|---|---|---|---|
| 6,336,382 | B2 * | 1/2002 | Cerda | B25B 13/461 81/177.85 |
| 6,883,402 | B2 * | 4/2005 | Cerda | B25B 13/461 81/177.85 |
| 7,024,969 | B2 * | 4/2006 | Smith | B25B 13/08 81/177.2 |
| 7,044,028 | B1 * | 5/2006 | Lozano | B25B 23/0021 81/177.85 |
| 8,141,462 | B2 * | 3/2012 | Richardson | B25B 13/04 81/177.2 |
| 8,312,795 | B2 * | 11/2012 | Richardson | B25B 23/0028 81/177.8 |
| 11,027,409 | B2 * | 6/2021 | Macor | B25B 23/0007 |
| 2006/0016297 | A1 * | 1/2006 | Smith | B25B 13/04 81/177.2 |
| 2009/0013834 | A1 * | 1/2009 | Richardson | B25G 1/043 81/177.8 |

(Continued)

*Primary Examiner* — David B. Thomas

(74) *Attorney, Agent, or Firm* — Guice Patents PLLC

(57) ABSTRACT

The present invention relates to a three-piece wrench comprising: a wrench body with a working head and a shaft, the working head is located at a front end of the shaft, the shaft has a length; a first extension rod with a length; and a second extension rod with a length; the lengths of the first extension rod and the second extension rod are greater than the length of the shaft; combination of the wrench body, the first extension rod and the second extension rod provides various usage lengths of the wrench, so that different connection types can be used to form required lengths according to requirements.

7 Claims, 8 Drawing Sheets

(56) References Cited

U.S. PATENT DOCUMENTS

| | | | | |
|---|---|---|---|---|
| 2010/0107828 | A1* | 5/2010 | Huerta | B25G 1/063<br>81/177.85 |
| 2014/0260829 | A1* | 9/2014 | Alfinito | B25B 23/0021<br>81/177.85 |
| 2021/0031354 | A1* | 2/2021 | Harr | B25B 13/462 |

* cited by examiner

THREE-PIECE WRENCH

BACKGROUND OF THE INVENTION

Field of Invention

The present invention relates to a tool, and more particularly to a three-piece wrench with various length variations.

Related Art

Generally, hand-held tools are provided with different lengths of grips in different usage states to be used for different requirements of driving force. Please refer to FIG. 1 for four conventional wrenches with four different lengths, when small torsion is required or in narrow operation area, a wrench 91 with a shortest length is used; for general use or general torsion requirements, a wrench 92 or 93 with a medium length is used; and if larger torsion operation is required, such as heavy machinery or large objects, a wrench 94 with a longest length is used, and a larger moment of force will be generated through a longer arm of force to facilitate users to apply a larger torsion value.

In the current technology, in order to cope with different occasions of usage and operating torsions, operators have to purchase the wrenches 91, 92, 93, 94 of different lengths for usage, in addition to the high costs of purchase, the different lengths will make it difficult to store away and larger storage space is required, and the four wrenches are heavy and inconvenient to carry.

SUMMARY OF THE INVENTION

An object of the present invention is to provide a three-piece wrench, so that a single wrench is capable of producing different length variations according to different requirements of usage.

Another object of the present invention is to provide a three-piece wrench capable of improving the convenience of use, reducing the purchase costs and facilitating portability.

A three-piece wrench provided by the present invention includes:

a wrench body having a shaft and a working head, the working head is located at a front end of the shaft, the shaft has a length;

a first extension rod with a length;

a second extension rod with a length;

two rear combination portions respectively provided at rear ends of the shaft and the first extension rod; and two front combination portions respectively provided at front ends of the first extension rod and the second extension rod, each of the front combination portions and each of the rear combination portions are detachably combined;

the lengths of the first extension rod and the second extension rod are greater than the length of the shaft; and the wrench body, the first extension rod and the second extension rod provide various lengths of usage for the wrench.

Thereby, the wrench body is capable of producing different length variations through variations in connection with or without the first extension rod and the second extension rod; when the wrench body is changed in length, changes can be done without the working head leaving a workpiece to increase the efficiency of changing length, and the first extension rod and the second extension rod can be directly combined with the wrench body when not in use, which can be conveniently stored away without occupying space.

Preferably, the length of the second extension rod is greater than the length of the first extension rod.

Preferably, the working head is integrally formed with the shaft.

BRIEF DESCRIPTION OF THE DRAWINGS

The objects, features and efficacies of the present invention can be understood from the description of the following preferred embodiments.

DETAILED DESCRIPTION OF THE INVENTION

Figure 1:
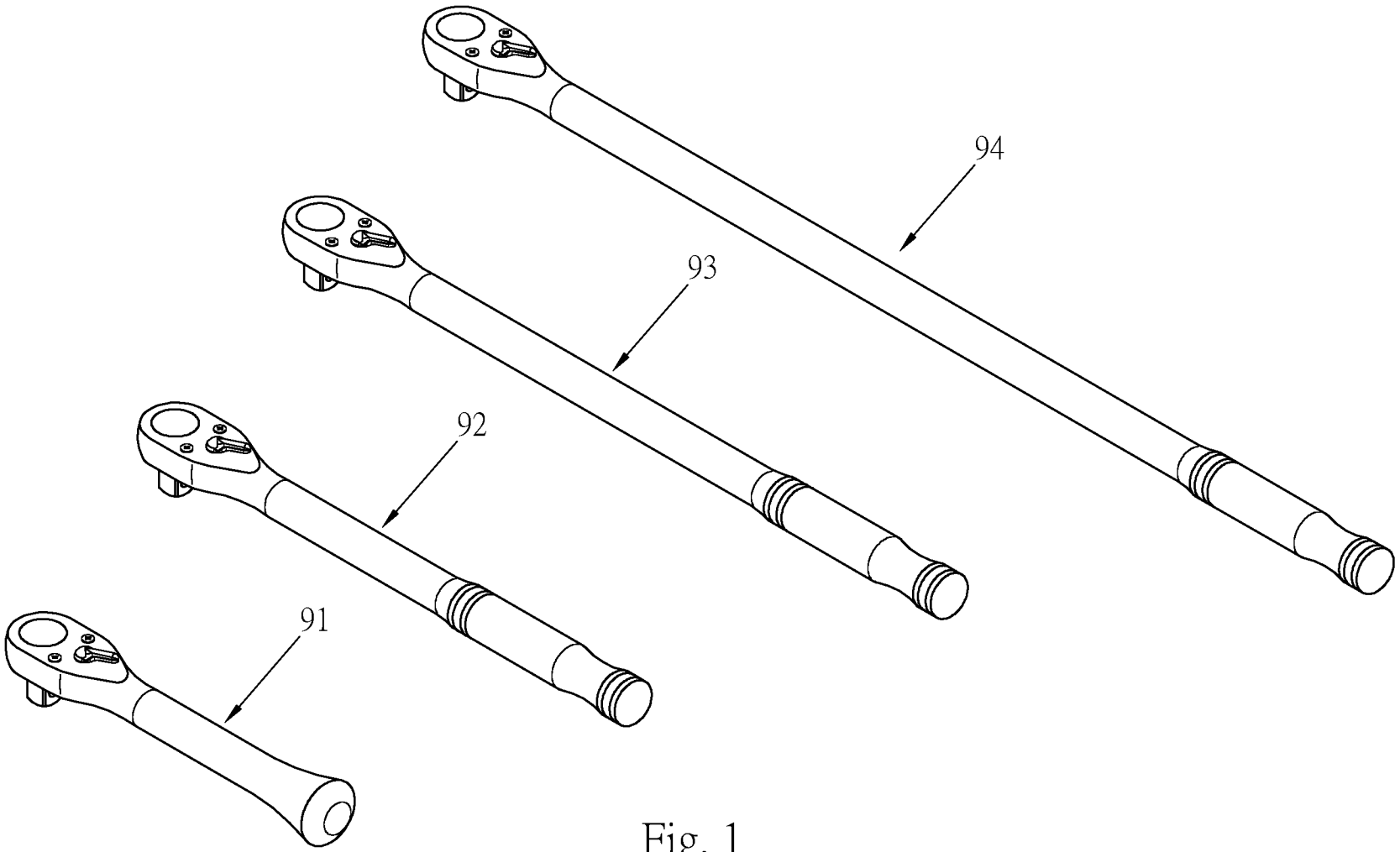
Fig. 1 PRIOR ART
FIG. 1 is a perspective view of conventional wrenches with different lengths.
Figure 2:
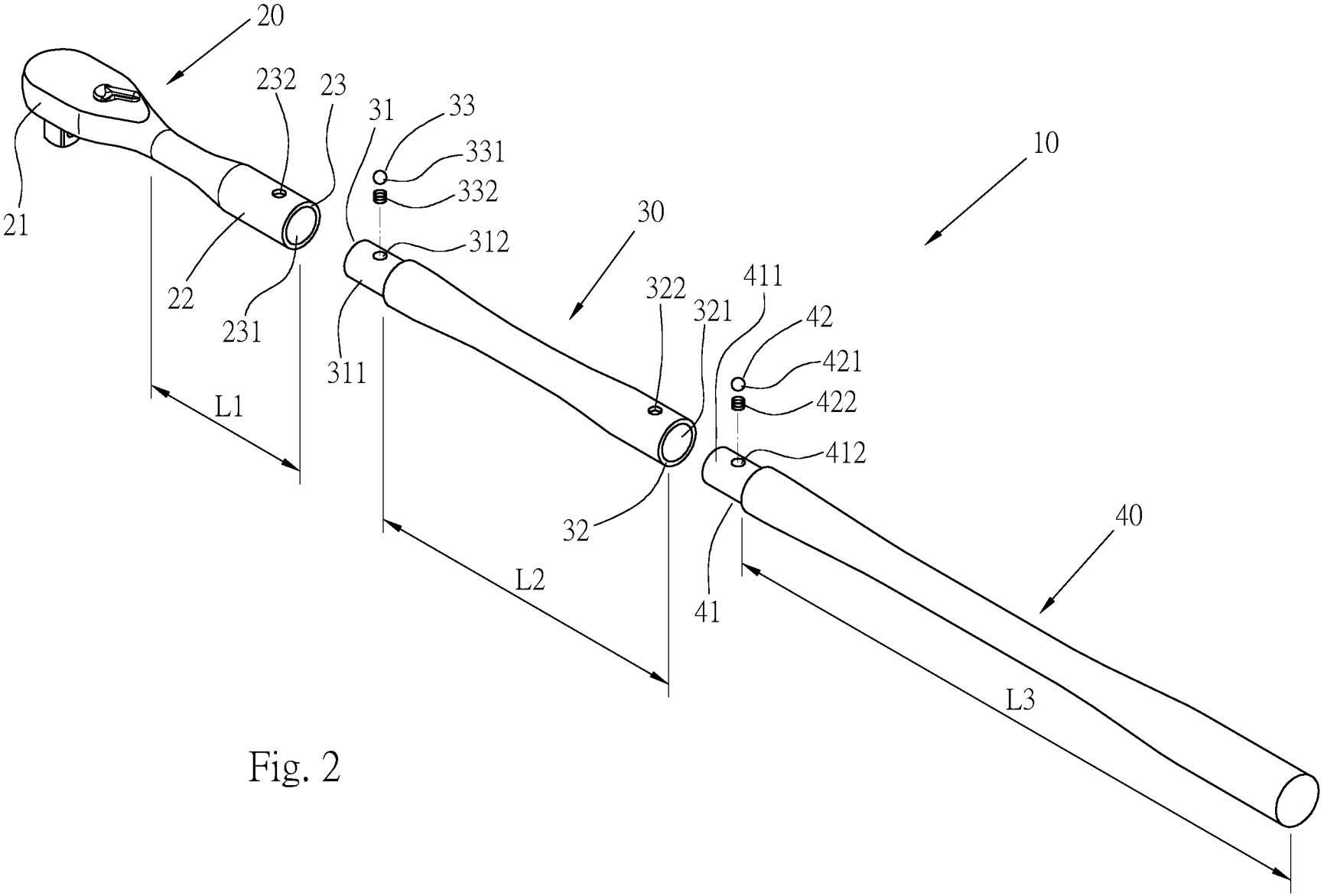
FIG. 2 is an exploded perspective view of a three-piece wrench of a first preferred embodiment of the present invention.
Figure 4:
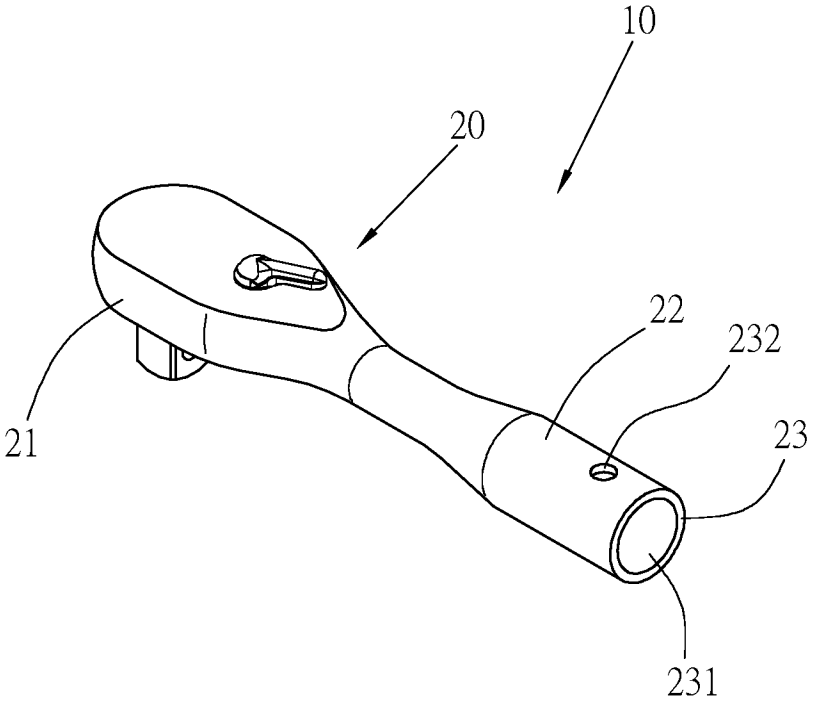
FIG. 4 is a perspective view of a wrench body of the first preferred embodiment of the present invention.
Figure 3:
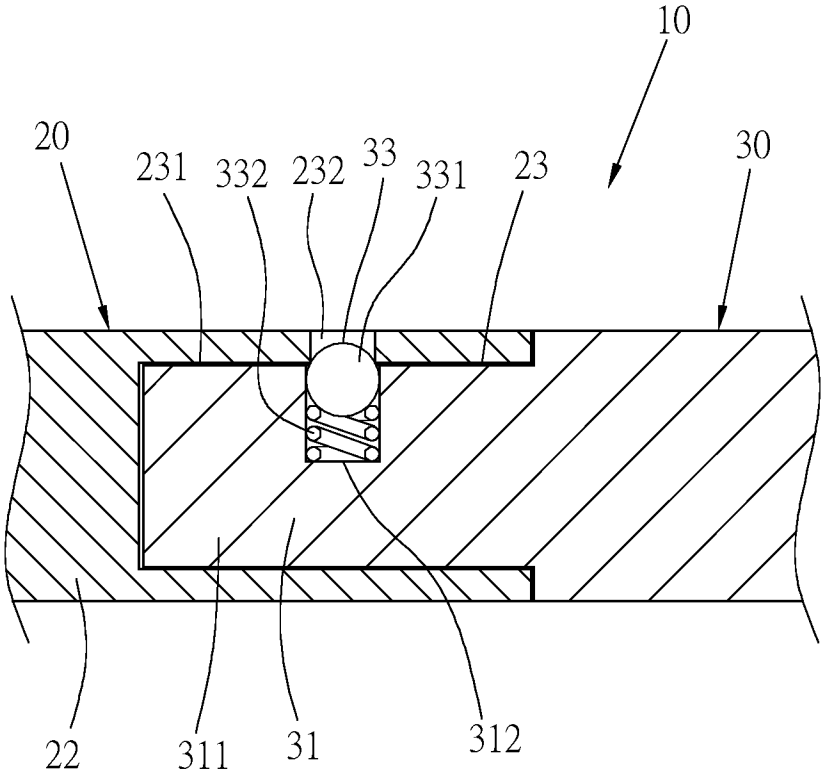
FIG. 3 is a cross-sectional view of a connection position of the first preferred embodiment of the present invention.

Please refer to FIG. 2 to FIG. 4 for a three-piece wrench 10 provided by a first preferred embodiment of the present invention, the three-piece wrench 10 mainly includes a wrench body 20, a first extension rod 30, and a second extension rod 40.

The wrench body 20 has a working head 21 and a shaft 22, the shaft 22 has a length L1, the working head 21 is located at a front end of the wrench body 20, and the working head 21 in this preferred embodiment is a ratchet head with a ratchet structure inside. The working head 21 can be of other forms, such as a working head with a polygonal fitting hole, which is not limited to what is shown in this preferred embodiment. The shaft 22 is located at a rear end of the wrench body 20 and is provided with a rear combination portion 23 at a rear end of the shaft 22. The rear combination portion 23 is an insertion slot 231 formed as a cylindrical slot to be recessed at the rear end of the shaft 22, and a peripheral wall of the insertion slot 231 is penetratingly disposed with a positioning hole 232.

The first extension rod 30 has a length L2, the length L2 is greater than the length L1 of the shaft 22. The first extension rod 30 is provided with a front combination portion 31 at a front end, and a rear combination portion 32 at a rear end with structure and dimensions the same as that of the rear combination portion 23 of the wrench body 20. The front combination portion 31 is a plug 311, which is a cylinder, and an accommodating hole 312 is provided on a peripheral surface of the plug 311 in a radial direction. An elastic positioning member 33 is disposed on the front combination portion 31 and in the accommodating hole 312, the elastic positioning member 33 is composed of a ball 331 and an elastic element 332. The front combination portion 31 can be combined with the rear combination portion 23 of the wrench body 20 so that the plug 311 can be inserted into the insertion slot 231. After the plug 311 is inserted into the insertion slot 231, the elastic element 332 of the elastic positioning member 33 will make the ball 331 to produce an elastic force, and the ball 331 can be elastically snapped in the positioning hole 232, so that the first extension rod 30 is capable of detachably inserting into the rear end of the wrench body 20. The rear combination portion 32 is provided with an insertion slot 321 at a rear end of the first extension rod 30, the insertion slot 321 is formed as a cylindrical hole of a same size as the insertion slot 231, and a peripheral wall of the insertion slot 321 is penetratingly disposed with a positioning hole 322.

The second extension rod 40 has a length L3 that is greater than the length L1 of the shaft 22 of the wrench body 20 and the length L2 of the first extension rod 30. The second extension rod 40 is provided with a front combination portion 41 at a front end with structure and dimensions the same as that of the front combination portion 31 of the first extension rod 30. The front combination portion 41 is a plug 411, formed as a cylinder of a same size as the plug 311, and an accommodating hole 412 is provided on a peripheral surface of the plug 411 in a radial direction. An elastic positioning member 42 is disposed on the front combination portion 41 and in the accommodating hole 412, the elastic positioning member 42 is composed of a ball 421 and an elastic element 422. The front combination portion 41 can be combined with the rear combination portion 23 of the wrench body 20 or the rear combination portion 32 of the first extension rod 30, so that the plug 411 can be inserted into the insertion slot 231 or the insertion slot 321. After the plug 411 is inserted into the insertion slot 231 or the insertion slot 321, the elastic element 422 of the elastic positioning member 42 will make the ball 421 to produce an elastic force, and the ball 421 can be elastically snapped in the positioning hole 232 or the positioning hole 322, so that the second extension rod 40 is capable of detachably inserting into the rear end of the wrench body 20 or the rear end of the first extension rod 30.

It can be known from the above description that the shaft 22 of the wrench body 20, the first extension rod 30 and the second extension rod 40 form three lengths, among which: the length L3 of the second extension rod 40 is the longest, the length L2 of the first extension rod 30 is the second longest, and the length L1 of the shaft 22 of the wrench body 20 is the shortest.

Please refer to FIG. 4, which shows one of the usage states of the three-piece wrench 10. The wrench body 20 can be used directly, users can directly hold on to a position of the shaft 22 of the wrench body 20 to rotate, and since the length L1 of the shaft 22 is short, it is suitable for use in small driving force and narrow space to facilitate operation.

Figure 5:
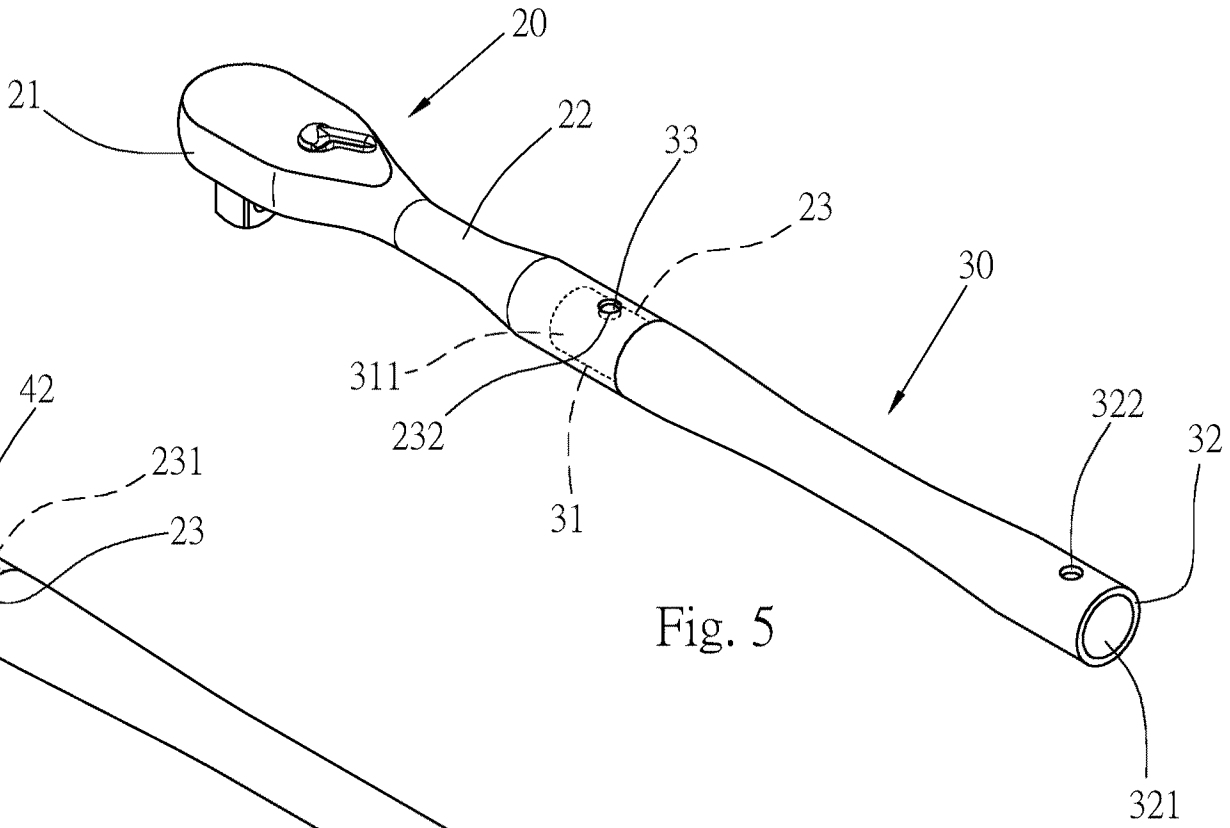
FIG. 5 is a perspective view of connection between the wrench body and a first extension rod of the first preferred embodiment of the present invention.

Please refer to FIG. 5, which shows a second usage state of the three-piece wrench 10. When a torsion of the wrench 10 needs to be increased, the front combination portion 31 of the first extension rod 30 can be inserted into the rear combination portion 23 of the wrench body 20, so that the plug 311 of the front combination portion 31 can be inserted into the insertion slot 231 of the rear combination portion 23, and the ball 331 of the elastic positioning member 33 is elastically snapped and limited in the positioning hole 232, and the front combination portion 31 can be fixed in the rear combination portion 23. After the first extension rod 30 is combined with the wrench body 20, a length of the wrench 10 (not including a length of the working head 21, the same hereinafter) becomes the length L1 of the shaft 22 of the wrench body 20 combined with the length L2 of the first extension rod 30. In this way, the wrench 10 forms a second length (L1+L2), which can provide a second operating arm of force and greater torsion.

In addition, as shown in FIG. 3, when the first extension rod 30 is to be removed from the rear end of the wrench body 20, firstly press the ball 331 of the elastic positioning member 33, so that the ball 331 can sink into the accommodating hole 312, the ball 331 no longer limits the positioning hole 232, and the plug 311 can be removed from the insertion slot 231.

Figure 6:
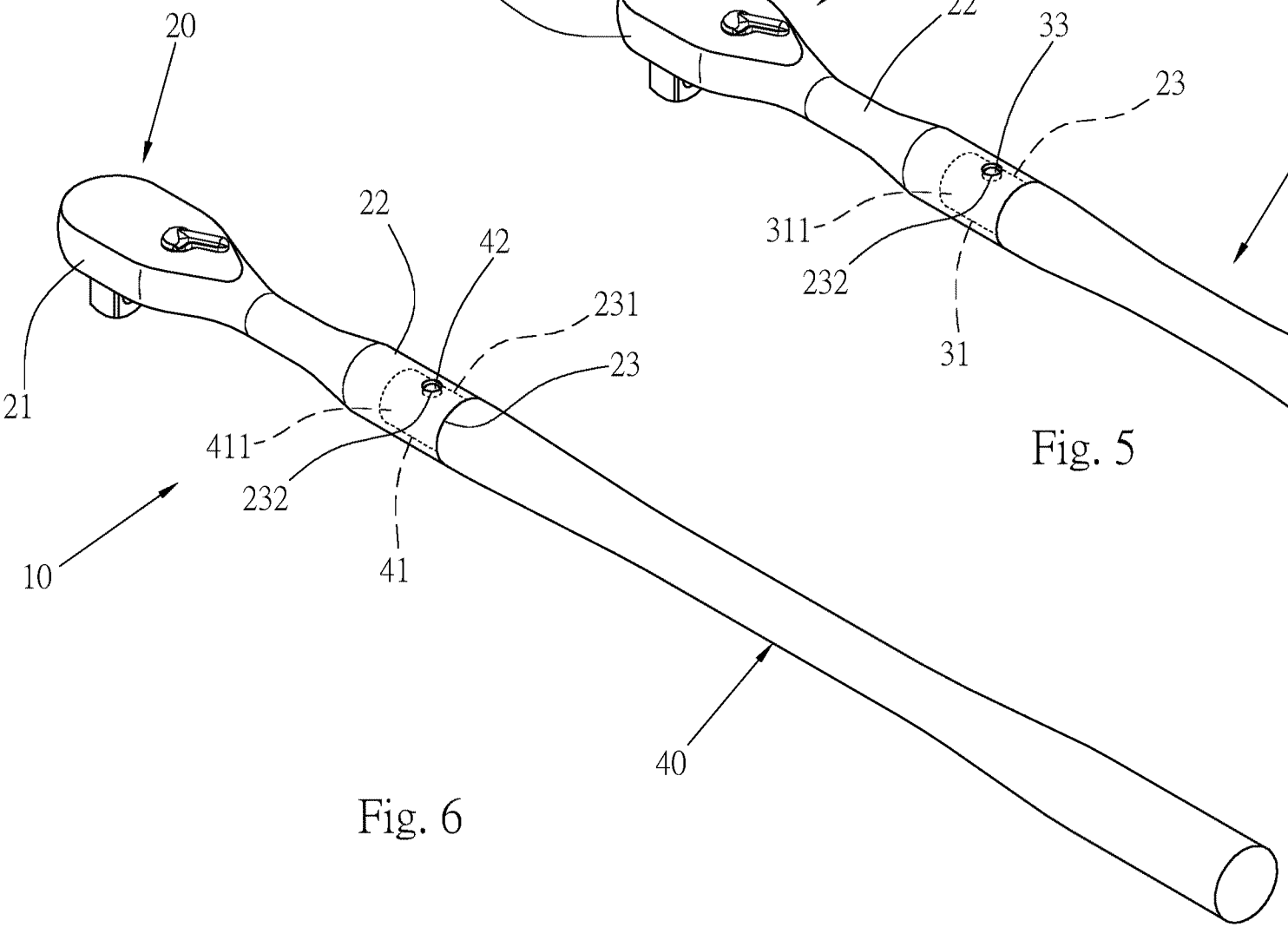
FIG. 6 is a perspective view of connection between the wrench body and a second extension rod of the first preferred embodiment of the present invention.

Furthermore, please refer to FIG. 6, which shows a third usage state of the three-piece wrench 10. The front combination portion 41 of the second extension rod 40 is combined with the rear combination portion 23 of the wrench body 20. Since the front combination portion 41 of the second extension rod 40 has the same structure and dimensions as that of the front combination portion 31 of the first extension rod 30, the plug 411 of the front combination portion 41 can be directly inserted into the insertion slot 231 of the rear combination portion 23, and the ball 421 of the elastic positioning member 42 on the plug 411 is elastically snapped and limited in the positioning hole 232 of the rear combination portion 23, so that the front combination portion 41 of the second extension rod 40 can be fixed in the rear combination portion 23 of the wrench body 20. After the second extension rod 40 is combined with the wrench body 20, the length of the three-piece wrench 10 is formed by the length L1 of the shaft 22 of the wrench body 20 combined with the length L3 of the second extension rod 40. In this way, the three-piece wrench 10 forms a third length (L1+L3), which can form a third operating arm of force and provide greater operating torsion.

Figure 7:
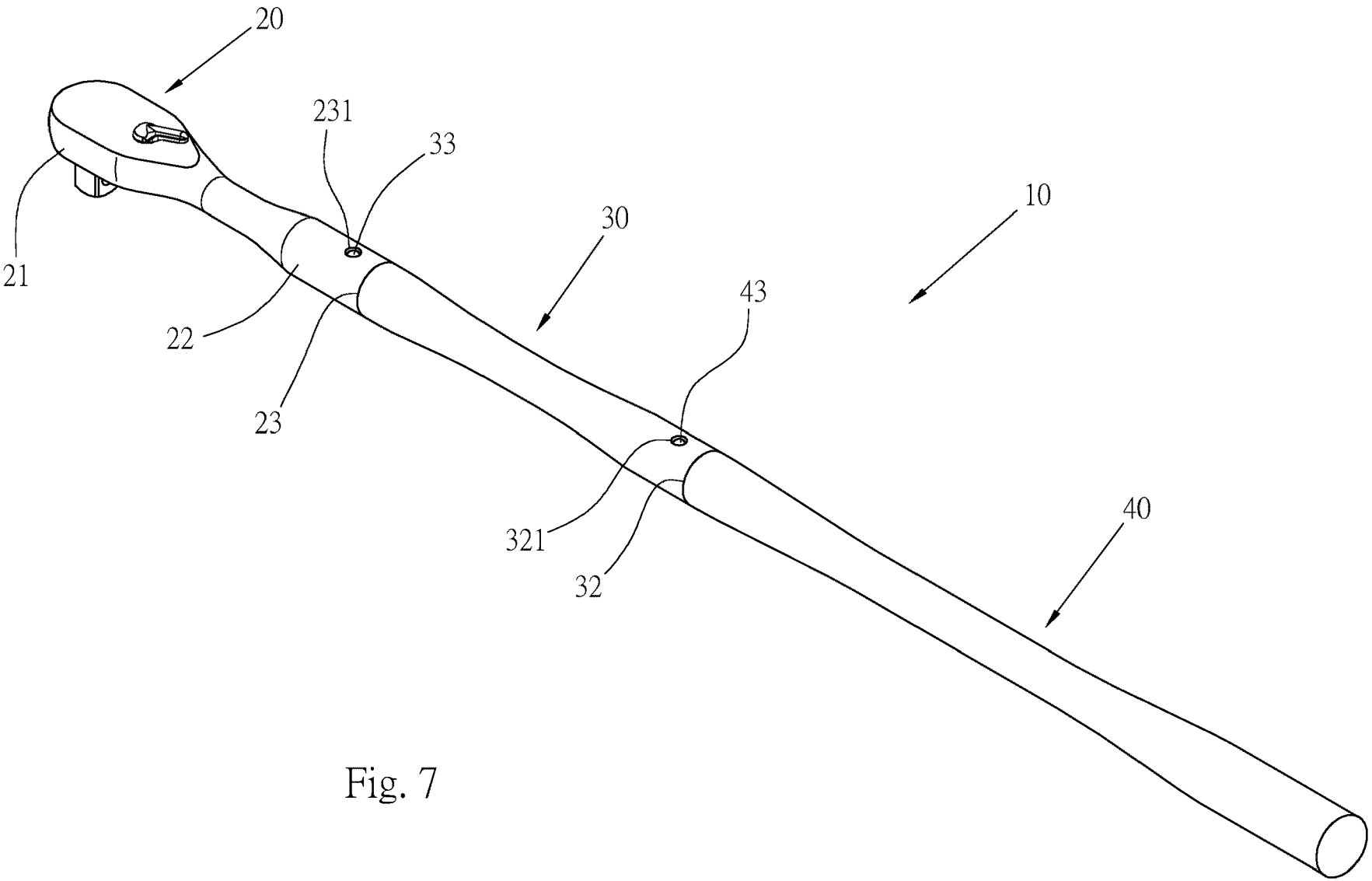
FIG. 7 is a perspective view of connections between the wrench body and the first extension rod and the second extension rod of the first preferred embodiment of the present invention.

Please refer to FIG. 7, which shows a fourth usage state of the three-piece wrench 10. To obtain a maximum usage length, firstly the front combination portion 31 of the first extension rod 30 is combined with the rear combination portion 23 of the wrench body 20, and then the front combination portion 41 of the second extension rod 40 and the rear combination portion 32 of the first extension rod 30 are combined together. Since the front combination portions 31, 41 and the rear combination portions 23, 32 can be combined with each other, the front combination portion 41 of the second extension rod 40 can be directly combined with the rear combination portion 32 of the first extension rod 30. Thereby, the length of the wrench 10 can be the longest, that is, a length (L1+L2+L3) formed by the shaft 22 of the wrench body 20 combined with the first extension rod 30 and the second extension rod 40. When using the wrench 10, the first extension rod 30 and the second extension rod 40 can be combined first, and then the front combination portion 31 of the first extension rod 30 is combined with the rear combination portion 23 of the wrench body 20.

In addition, when the wrench 10 is changed in length, the working head 21 of the wrench body 20 can be fixed on a workpiece (not shown in the figures) to perform the change directly without removing the wrench body 20 to increase the operating efficiency. After the three-piece wrench 10 is used, the first extension rod 30 and the second extension rod 40 can be directly combined to the rear end of the wrench body 20 and stored away as a whole to reduce required storage space and avoid the situation where the corresponding lengths cannot be found.

Figure 8:
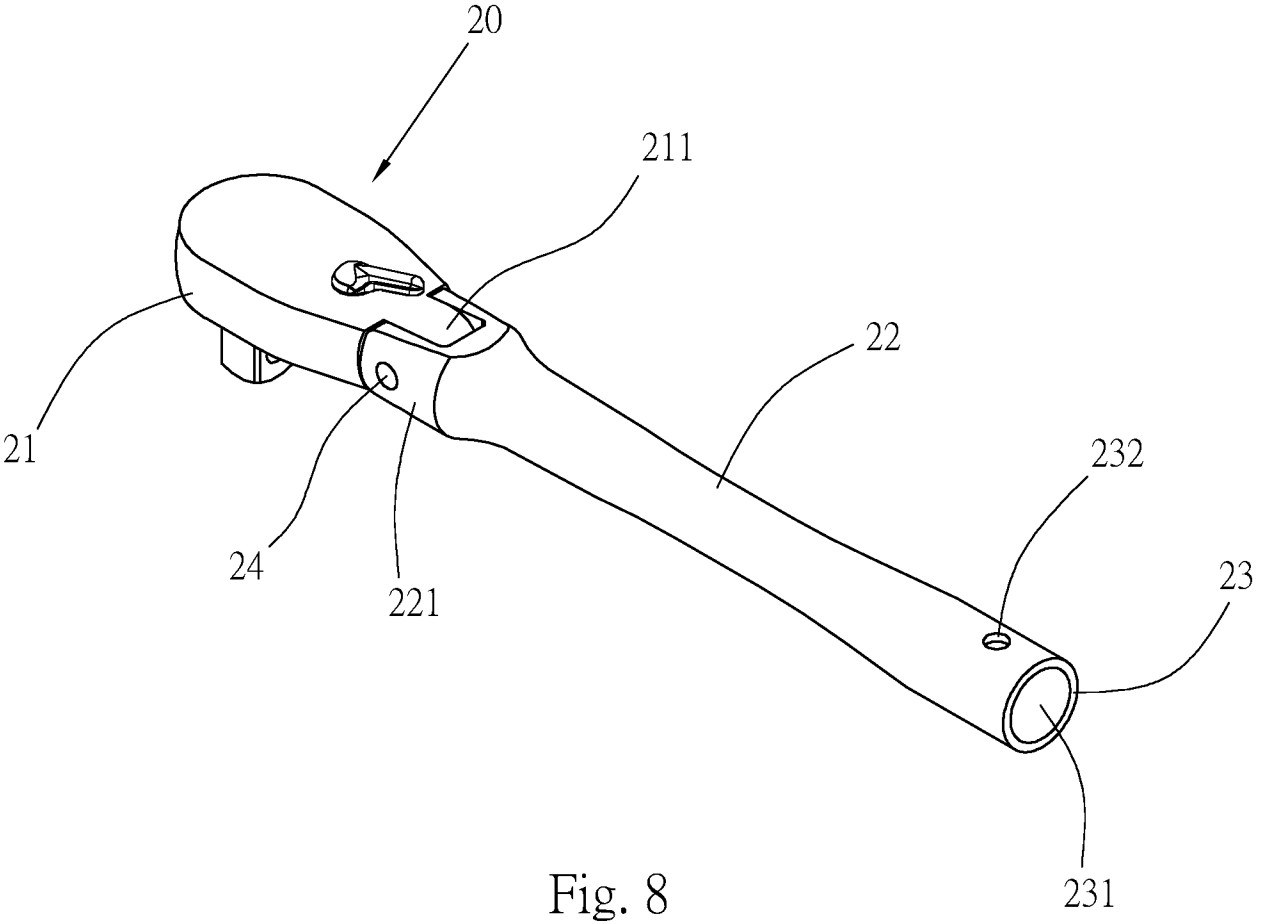
FIG. 8 is a perspective view of the wrench body of a second preferred embodiment of the present invention.

Please refer to FIG. 8, which is the three-piece wrench provided by a second preferred embodiment of the present invention. The structures of the first extension rod 30 and the second extension rod 40 are the same as that of the first embodiment, so they will not be described in detail, wherein:

the working head 21 and the shaft 22 of the wrench body 20 are separated parts, a rear end of the working head 21 is provided with a first connecting portion 211, which is a protrusion, and a front end of the shaft 22 being another end opposite to the rear combination portion 23 is disposed with a second connecting portion 221, which is two lugs; after the first connecting portion 211 and the second connecting portion 221 are connected with each other, a plug pin 24 passes through the first connecting portion 211 and the second connecting portion 221 to form a pivotal connection between the first connecting portion 211 and the second connecting portion 221, so that an operating angle between the working head 21 and the shaft 22 of the wrench body 20 can be adjusted to increase the variability of adjustment in an operating space.

Figure 9:
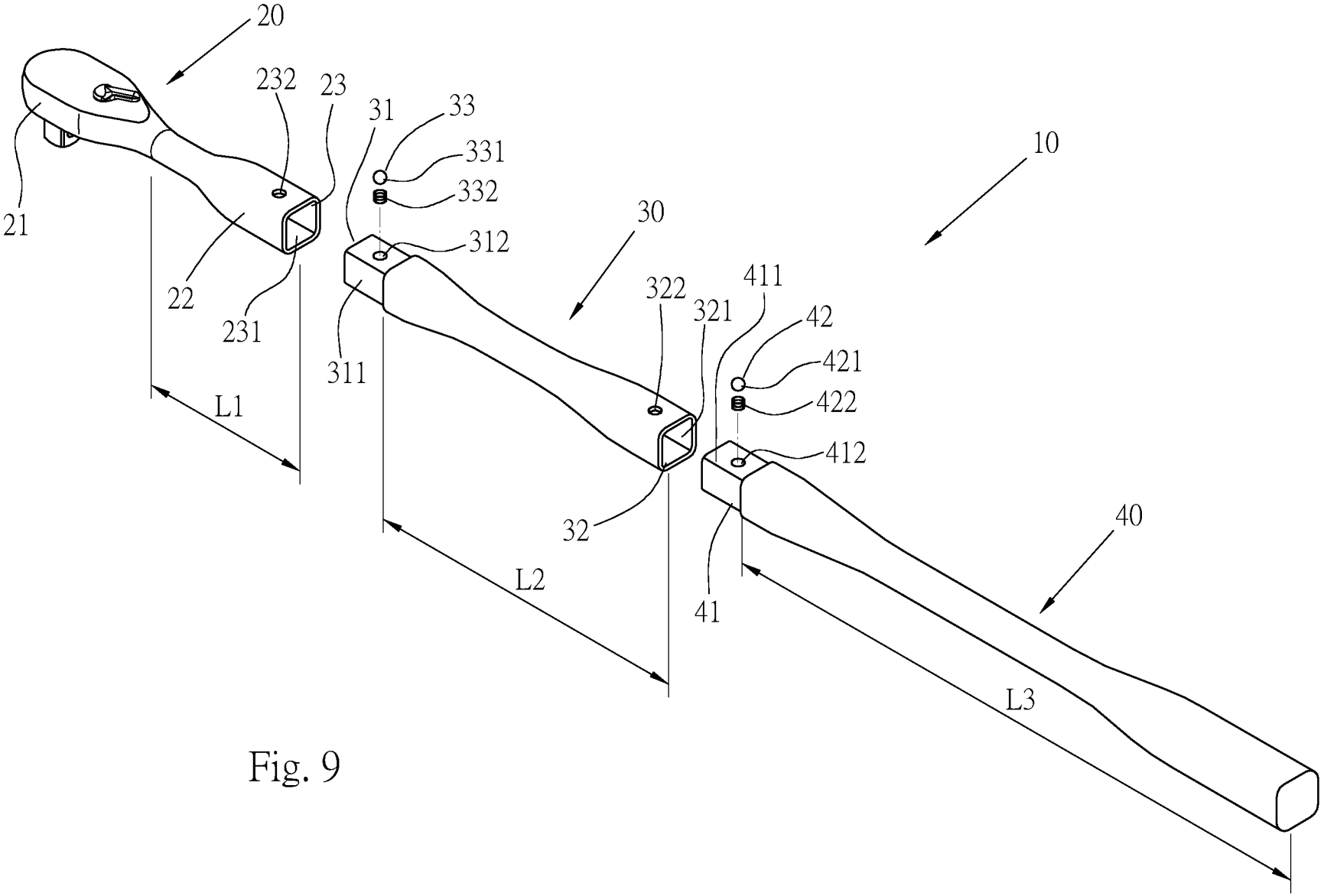
FIG. 9 is an exploded perspective view of the three-piece wrench of a third preferred embodiment of the present invention.

Please refer to FIG. 9 for the three-piece wrench provided by a third preferred embodiment of the present invention, and the main structures are the same as that of the first embodiment, so they will not be described in detail, wherein:

the insertion slot 231 of the rear combination portion 23 of the wrench body 20 and the insertion slot 321 of the rear combination portion 32 of the first extension rod 30 are formed as square slots, and the plug 311 of the front combination portion 31 of the first extension rod 30 and the plug 411 of the front combination portion 41 of the second extension rod 40 are correspondingly formed as square cylinders, variation in shapes of the plug and the insertion slot is not limited, as long as the shapes are complementary and can be combined and fixed with each other.

Figure 10:
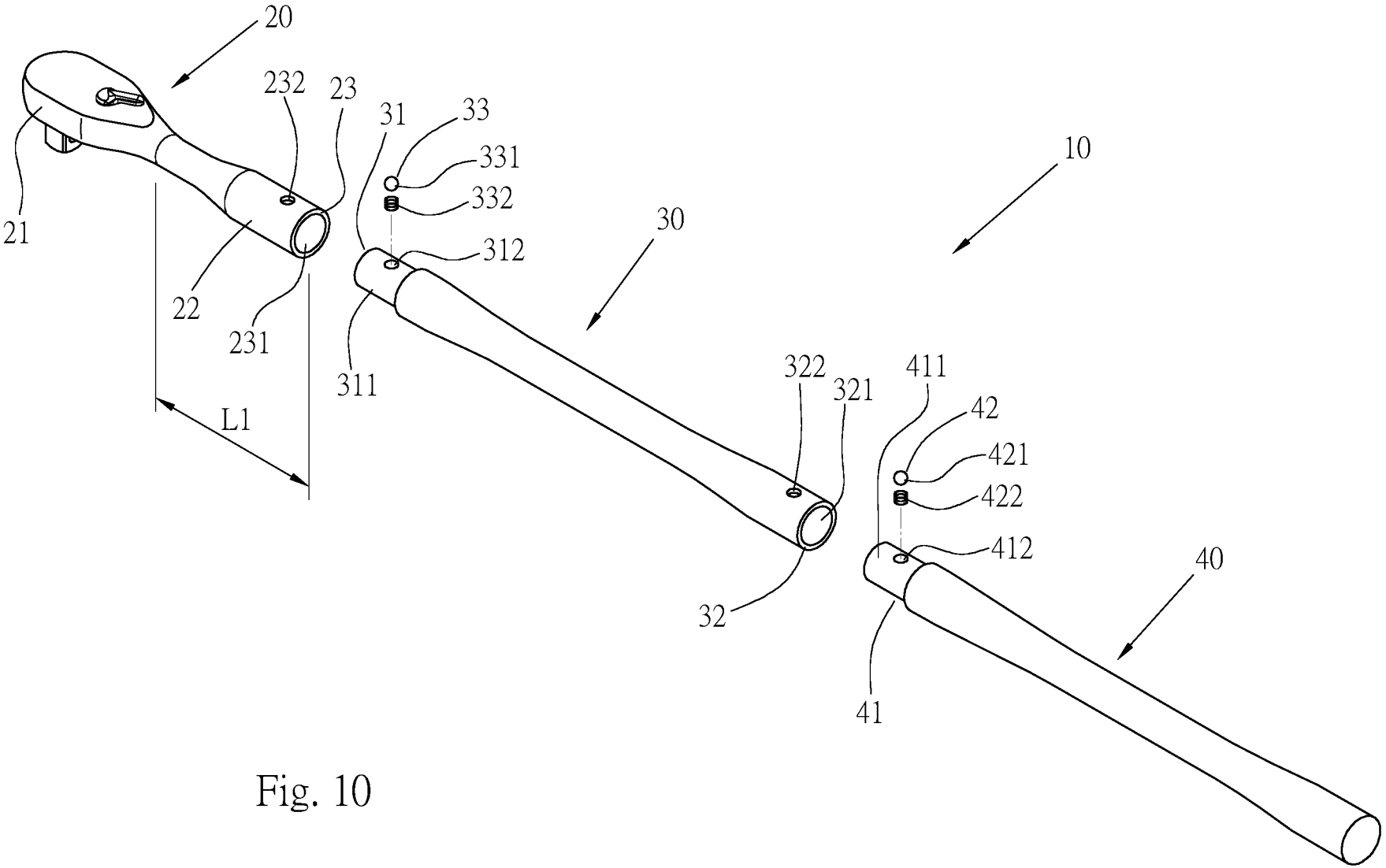
FIG. 10 is an exploded perspective view of the three-piece wrench of a fourth preferred embodiment of the present invention.

Please refer to FIG. 10 for the three-piece wrench provided by a fourth preferred embodiment of the present invention, and the main structures are the same as that of the first embodiment, so they will not be described in detail, wherein:

in this preferred embodiment, since the length L2 of the first extension rod 30 and the length L3 of the second extension rod 40 are the same, the combined length (L1+L2) of the first extension rod 30 and the wrench body 20 is the same as the combined length (L1+L3) of the second extension rod 40 and the wrench body 20, in addition, the length L1 of the wrench body 20 is used alone, and the wrench body 20 is combined with the first extension rod 30 and the second extension rod 30 (L1+L2+L3), and thus the three-piece wrench 10 is capable of producing three different length variations, and users can arbitrarily choose to use the first extension rod 30 or the second extension rod 40 to combine with the wrench body 20 to obtain an equivalent moment of force.

The three-piece wrench provided by the present invention is capable of forming different length variations through combination of the different extension rods to produce different changes in length. Compared with the conventional wrench being a single tool with only one length, the present invention is capable of increasing the length applicability and variability of the wrench, producing various length variations by using only one wrench, also reducing the purchase costs and required storage space, reducing the weight of the wrench, and facilitating portability.

It is to be understood that the above description is only preferred embodiments of the present invention and is not used to limit the present invention, and changes in accordance with the concepts of the present invention may be made without departing from the spirit of the present invention, for example, the equivalent effects produced by various transformations, variations, modifications and applications made to the configurations or arrangements shall still fall within the scope covered by the appended claims of the present invention.

What is claimed is:

1. A three-piece wrench including:

a wrench body having a shaft and a working head, the working head being located at a front end of the shaft, the shaft having a length;

a first extension rod with a length;

a second extension rod with a length;

two rear combination portions respectively provided at rear ends of the shaft and the first extension rod, each said rear combination portion of the two rear combination portions has a same and uniform cross section extending a length thereof; and two front combination portions respectively provided at front ends of the first extension rod and the second extension rod, each of the front combination portions and each of the rear combination portions being detachably combined;

the lengths of the first extension rod and the second extension rod being greater than the length of the shaft; and the wrench body, the first extension rod and the second extension rod providing variations in combination of various lengths of usage for the wrench;

wherein the length of the second extension rod is greater than the length of the first extension rod;

wherein each of the rear combination portions is respectively formed with an insertion slot, each of the front combination portions is respectively formed with a plug, and each of the plugs is capable of inserting into or detaching from each of the insertion slots.

2. The three-piece wrench as claimed in claim 1, further including two elastic positioning members respectively provided between each of the plugs and each of the insertion slots, when each of the plugs inserting into each of the insertion slots, the elastic positioning member keeping the plug in position.

3. The three-piece wrench as claimed in claim 2, wherein the two elastic positioning members are respectively composed of an elastic element and a ball, the two plugs are concavely provided with an accommodating hole respectively, so that each of the two elastic elements with each of the two balls can be respectively accommodated in one of the two accommodating holes, and peripheral walls of the two insertion slots are penetratingly disposed with a positioning hole respectively.

4. The three-piece wrench as claimed in claim 1, wherein the insertion slot is a cylindrical slot, and the plug is a cylinder.

5. The three-piece wrench as claimed in claim 1, wherein the insertion slot is a polygonal slot, and the plug is a polygonal cylinder.

6. The three-piece wrench as claimed in claim 1, wherein the working head is integrally formed with the shaft.

7. The three-piece wrench as claimed in claim 1, wherein a rear end of the working head has a first connecting portion, the front end of the shaft has a second connecting portion, and a plug pin is pivotally connected with the first connecting portion and the second connecting portion overlap, so that the working head is capable of swinging relative to the shaft.

* * * * *